US005411148A

United States Patent [19]

Kelebek et al.

[11] Patent Number: 5,411,148

[45] Date of Patent: May 2, 1995

[54] SELECTIVE FLOTATION PROCESS FOR SEPARATION OF SULPHIDE MINERALS

[75] Inventors: Sadan Kelebek, Levack; Peter F. Wells, Sudbury; Simon O. Fekete, Thornhill, all of Canada

[73] Assignee: Falconbridge Ltd., Toronto, Canada

[21] Appl. No.: 82,574

[22] Filed: Jun. 28, 1993

[30] Foreign Application Priority Data

Nov. 13, 1992 [CA] Canada ..... 2082831

[51] Int. Cl.[6] ..... B03D 1/01; B03D 1/018; B03D 1/002; B03D 1/02

[52] U.S. Cl. ..... 209/166; 209/167; 252/61

[58] Field of Search ..... 209/166, 167, 901; 252/61

[56] References Cited

U.S. PATENT DOCUMENTS 3,607,069 9/1971 Bruen et al. .
4,078,993 3/1978 Griffith et al. ..... 209/167
4,139,455 2/1979 Griffith et al. ..... 209/167
4,283,017 8/1981 Coale .
4,460,459 7/1984 Shaw .
4,515,688 5/1985 Vargas .
4,735,783 4/1988 Bulatovic .
4,877,517 10/1989 Bulatovic et al. ..... 209/167
4,879,022 11/1989 Clark .
5,074,993 12/1991 Kerr et al. ..... 209/167

*Primary Examiner*—Thomas M. Lithgow
*Attorney, Agent, or Firm*—Keck, Mahin & Cate

[57] ABSTRACT

This invention provides a process for improved separation of mono/multi-metallic sulphide minerals from significant amounts of iron sulphides, mainly pyrrhotite and/or their finely divided process middlings. The process comprises subjecting such material to a conditioning stage with at least one water-soluble sulphur-containing inorganic compound as a prerequisite step for further conditioning with nitrogen-containing organic chelating agents, preferably polyethylenepolyamines, prior to froth flotation wherein iron mineral, primarily pyrrhotite is depressed, thus allowing selective recovery of mono/multi-metallic minerals containing non-ferrous metal value(s).

14 Claims, No Drawings

SELECTIVE FLOTATION PROCESS FOR SEPARATION OF SULPHIDE MINERALS

This invention relates to the selective separation of sulphide minerals associated with iron sulphides, especially with pyrrhotite.

BACKGROUND OF THE INVENTION

Sudbury basin ores, like many other sulphide deposits, contain pyrrhotite which, having little or no commercial value, may be regarded as a sulphide gangue. Sudbury ores comprise in an increasing order of abundance: chalcopyrite (Cp), pyrite (Py), pentlandits (Pn), and nickeliferous pyrrhotite (Po) as the principal sulphides along with some other sulphides in small and variable amounts. Non-sulphide gangue minerals consist of mainly quartz and feldspar along with minor quantities of tremolite, biotite, magnetite and talc. Pyrrhotite which typically represents between 20 and 25% of the ors, is intimately associated with other minerals, primarily with pentlandits. In the treatment of such complex ores, some process streams may consist essentially of all pentlandite-pyrrhotite middlings containing more than 70% pyrrhotite. These streams have always presented a serious separation problem. Most of the complex sulphide ores of different mineralogy have similar separation problems. Poor separations result in low concentrate grades of valuable minerals. The presence of iron sulphides in the concentrates of non-ferrous base metals is almost always undesirable. In the processing of nickel-copper ores in the Sudbury region, a selective separation process will allow an economical rejection of the least valuable sulphide component, pyrrhotite which is the main contributor to sulphur dioxide emissions from smelters.

Pyrrhotite is separated from its associated minerals using a process of magnetic separation or flotation. The field of present invention is the latter. In general, the flotation process involves the grinding of the crushed ore in a dense slurry to the liberation size, followed by conditioning with reagents in a suitably dilute slurry. Broadly, reagents may function as collectors which determine the surface hydrophobicity (aerophilicity) of minerals, frothers which generate stable bubbles of suitable sizes in slurry for the capture and transfer of particles to the froth phase for their removal as concentrate, depressants which have the reverse action to collectors causing the surfaces of selected mineral particles to become hydrophilic thus allowing their rejection to tails. Flotation may be carried out as a single stage or in multiple stages.

The present invention describes a process for depressing iron sulphides and more specifically pyrrhotite and nickeliferous pyrrhotite during the flotation of nickel and other valuable base metal sulphides. It is of the utmost importance that any depressant used in a commercial operation be consistently effective and, while a variety of reagents are recognized as having selective function in the flotation of minerals containing various base metals, their action alone has been found to be unpredictable on pyrrhotite. Diethylenetriamine (DETA) is one of the preferred reagents employed for the purpose of the current invention. The depressant action of DETA in sulphide mineral beneficiation is known in the art. This is a reagent common to three U.S. patents issued to Griffith et al (U.S. Pat. No. 4,139,455), Bulatovic et al (U.S. Pat. No. 4,877,517) and Kerr et al (U.S. Pat. No. 5,074,993).

DETA ($H_2N—CH_2—CH_2—NH—CH_2—CH_2—NH_2$) belongs to a family of polyamines with a general technical name "[n] ethylene [n+1] amine" representing a series of relatively simple ligands. An ethyleneamine unit is added into molecular structure to form a homologous series. The simplest member of the family is monoethylenediamine (n=1), which is designated in chemical literature by its short version as "en". Similarly, diethylenetriamine (DETA) is commonly known by its short form as "dien" (i.e., n=2), triethylenetetramine as "trien" (i.e., n=3). These polyamines do not have any tertiary amine group in their structure.

The polyethylenepolyamine depressants, exemplified in the current process by DETA, differ from the iron sulphide depressants described by Griffith et al (U.S. Pat. Nos. 4,078,993 and 4,139,455) and by Bulatovic et al (e.g., U.S. Pat. No. 4,877,517) in that the latter are essentially the reaction products of several additional reagents such as formaldehyde, adipic acid, caustisized starch, polyacrylic acid etcetera. The process disclosed by Griffith et al. also requires a tertiary amine group to be present in the depressant structure. The resulting polymeric structures are viscous, having rather large molecules in which the nitrogen atom is a link in the polymer chain structure.

U.S. Pat. No. 5,074,993 to Kerr et al., issued on Dec. 24, 1991, describes the use of water-soluble polyamines as a pyrrhotite depressant for the selective flotation of nickel-copper minerals. The success of the process is demonstrated by various examples, using feed samples in which Po/Pn ratio is relatively low, with one exception (at 15) lower than 10. The process behaviour of pyrrhotite-rich streams is not necessarily the same as those containing relatively low pyrrhotite content. As those skilled in the art would readily agree, the difficulty in Pn-Po separation by selective flotation of pentlandits from pyrrhotite increases with an increase in Po/Pn ratio of the feed to a specific flotation stage. Accordingly, a different set of conditions is usually required to meet the special demands of the processes intended for difficult-to-treat complex sulphides. As will be noted in the examples to follow, the depression effect on pyrrhotite of DETA by itself is unacceptably poor in the treatment of Po-rich process middlings.

The current invention differs from the process described by Kerr et al (U.S. Pat. No. 5,074,993) as well as those by Griffith et al and Bulatovic et al (already cited hereinbefore) in that it provides a specific conditioning stage with sulphur-containing auxiliary reagents. In the patent to Kerr et al, the NCCN configuration of said polyamines is emphasized as a specific requirement for the depression effect on pyrrhotite, an observation that also differs from that provided in the current disclosure.

One of the reagents tested is histidine which has the following structural formula:

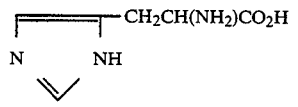

It has a primary amine group attached to ethylene chain which in turn is attached from one end to a five-membered ring containing two nitrogen atoms as in tertiary and secondary amines, respectively. For the purpose of comparison in terms of atomic arrangement, this molecular structure may be viewed as OCNCCCNCNC or alternatively, OCNCCCCNCN owing to the ring moiety. As will be noted from the results in specific examples, this structure is also capable of depressing pyrrhotite in preference to pentlandits. However, the depressant function induced by both this configuration and the NCCN configuration in DETA structure is dependent on an essential process stage which constitutes the essence of the current invention.

SUMMARY OF THE INVENTION

This invention provides a method for the selective flotation of sulphide minerals containing non-ferrous metals from iron sulphides, specifically pyrrhotite. Included non-ferrous minerals are those of nickel, cobalt and copper together with associated precious metals from sulphide ores of the type common to the Sudbury basin deposits, as well as other base metal-sulphides, such as those of zinc and lead, which may co-exist with pyrrhotite.

The essence of the process is a specific conditioning of the pulp containing pyrrhotite and other metal sulphides with a sulphur containing reagent, prior to or while conditioning with a reagent such as DETA. The sulphur containing reagent ensures the action of the DETA and results in consistent selective depression of pyrrhotite. The pyrrhotite containing stream may be either a freshly ground ore or a pre-treated and finely ground process intermediate. The sulphur containing reagent may be any of a series of water-soluble compounds which include, but are not restricted to, sulphides (including hydrosulphides and polysulphides), sulphites (including metabisulphites, and hydrosulphites), dithionates and tetrathionates, and finally, sulphur dioxide as the gas and selected mixtures of the above. The cationic part, if any, of the above compounds may consist of but is not limited to hydrogen, sodium, potassium, ammonium, calcium, barium. Other reagents include standard collectors and frothors with their familiar functional properties in sulphide flotation.

DESCRIPTION OF THE INVENTION

The current process invention is primarily directed to the separation of the sulphide minerals of non-ferrous metals (as specified heretofore) from iron sulphides consisting mainly of pyrrhotite using a selective method of froth flotation. More specifically, the flotation feed or process stream that benefits from the present invention is characterized by a fairly fine grind size and a variable ratio between pyrrhotite and the non-ferrous metal-containing sulphide mineral which is mainly associated with it (e.g., pentlandits used in the current process demonstration). This ratio may sometimes be low, but it is usually higher than 10, typically close to 30, however, at times exceeding even 60, thus representing a mixture of sulphides that is difficult to separate. In this process, the pulp containing said sulphide minerals is conditioned to provide a favourable chemical environment for the effective action of nitrogen-containing organic substances, including polyethylenepolyamines such as diethylenetriamine, triethylenetetramine or their selected mixtures. This conditioning step may be effected prior to, during or after contacting the pulp with nitrogen-containing chelating reagents. Depending on the pH conditions and the amount of pyrrhotite content in the pulp, the dosages (expressed as Kg reagent per ton of dry solids processed, Kg/ton) required for the former conditioning vary, for example, from 0.1 to 3.00 and 0.05 to 0.60 for the latter, respectively.

Other reagents that are usable in the current process are sulphide collectors such as alkyl xanthates (e.g., sodium isobutyl xanthate, SIBX), dialkyl dithiophosphinates, thionocarbamates or dithiophosphates and frothers such as DOWFROTH TM 250 and methyl isobutyl carbinol (MIBC). The dosages of these typical reagents change from 0 to 0.05 Kg/ton, the former representing the "no new addition" case due to a sufficient amount of residual collector and frother already being present in the process stream. It is to be noted that the type of collector or frother is not a dominant factor in the process of the current invention.

The process middlings are subjected to fine grinding in order to reduce the particles of sulphide minerals to liberation size. This may comprise one or more stages using well established methods of size reduction. For the purposes of characterization, the product from the fine grinding is at least 70% finer than 44 micrometers, a figure that significantly differs from the range 62 to 210 micrometers underlined in the U.S. Pat. No. 5,074,993. As stated by the inventors, Kerr et al "this size range avoids excessively fine slime producing material and excessively coarse material which is not amenable to selective flotation". One of the objects of the current invention has been to provide a flotation method that is capable of selective separation of minerals in a finely ground feed, i.e., much finer than the range 62 to 210 micrometers.

Reagents suitable for the surface modification step, which the current process relies on, are water-soluble sulphur-containing inorganic compounds including calcium polysulphide, sodium sulphide, ammonium sulphide, barium sulphide, sodium sulphite, sodium metabisulphite, sodium hydrosulphite, sulphur dioxide in suitable dosages and combinations with nitrogen-containing chelating agents. These are cited here only as examples since the success of the current process is not limited to these specific citations which are merely intended to serve for the purposes of process demonstration.

The calcium polysulphide used in the current invention may be freshly prepared as follows: elemental sulphur is added to a container having sufficient amount of water which is saturated with lime ($Ca(OH)_2$) present in excess amount. The contents are stirred for an extended period at room temperature for the dissolution of sulphur in the highly alkaline medium. The period of preparation may be shortened by heating the contents. After the colour of the solution turns to a deep yellow, the excess solids may be filtered off, if desired, prior to the direct addition of the solution into the flotation cell in a sufficient amount. For use in the bench scale tests, the preparation of this solution may be carried out in a 1 liter flask while bubbling nitrogen gas through it. The polysulphide solution thus prepared is referred to as reagent K in the tables of examples and has highly negative redox potentials (e.g. −575 mV, SCE at about pH=12 and 20° C.).

The sulphur-containing reagents, if desired, may be added directly into the flotation cell in solid or gas form to exploit their full strength. The dosages required range from 0.05 to 3.00 Kg/ton depending on the feed to be treated. In addition to sodium sulphide, the use of barium sulphide (black ash) or ammonium sulphide produce the required conditioning effect on pyrrhotite. These sulphides are used in combination with various sulphites (e.g. sodium metabisulphite). In using most of these sulphites or sulphur dioxide, the pH of pulp decreases. The pH may drop to a value as low as 6.5 to 7. In the preferred embodiment of the invention, the flotation pH should be between 9 and 9.5 obtained by subsequent or simultaneous addition of an alkali.

The mass balances referred to in the tables given in the examples are based on the weight recoveries and the chemical analyses of nickel, copper and sulphur in the flotation products. These chemical assays are related to the composition of associated minerals by the following equations:

$$Pn\% = 2.80*Ni\% - 0.045*(S\% - Cu\%)$$

$$Po\% = 2.55*S\% - 2.58*Cu\% - 2.33*Ni\%$$

which have been established over the years on the basis of regular mineralogical stoichiometry as well as the average amount of nickel that is chemically present in the pyrrhotite matrix. The efficiency of separation may be judged by the relative recoveries of pentlandite and pyrrhotite as well as the Po/Pn ratio and the grade of the final tails and concentrates. For the latter, the percent nickel in nickel bearing sulphides (% Ni/NBS) may also be considered which is given as follows;

$$\%\ Ni/NBS = Ni\%/100*(Pn\% + Po\%)$$

For highly selective separations that produce high concentrate grades, the final tail grade expressed in this unit is in the vicinity of 1.00 representing a tailing product acceptable for efficient pyrrhotite rejection.

Some detailed examples of the selective flotation process in accordance with the invention will now be presented.

EXAMPLE 1

In this example, the flotation data obtained with and without the use of DETA is examined. A sample with a Po/Pn ratio of about 28 from a Ni-Cu ore processing plant in the Sudbury region was employed after grinding to 85% finer than 44 micrometers.

A representative feed containing approximately 1550 gram (dry basis) was ground at 65% solids in a laboratory rod mill. The ground slurry was washed into a 4 litre Denver TM flotation cell, diluted with process water to about 30% solids and floated at an air flowrate of 3 litre/minute. The impeller speed was maintained at 1600 rpm. The collector (sodium isobutyl xanthate) and the frother (DOWFROTH TM 250) addition rate was 0.01 Kg/ton and 0.007 Kg/ton respectively. The total conditioning time for all reagents used was 5 minutes. The pH was adjusted with lime to about 9.5. Four concentrates were collected incrementally during a total flotation period of 20 minutes. The test method described here constitutes a standard procedure which has been used in testing various batches. In the examples to follow, only the deviations from this practice will be specified.

Table 1 and Table 2 show the results obtained in the blank test involving no DETA and the test carried out using 0.30 Kg/ton DETA, respectively.

TABLE 1

| | | 0 Kg/t DETA | | | | | | | | | | | |
|---|---|---|---|---|---|---|---|---|---|---|---|---|---|
| Flotation | Cum. | Cumulative Assays | | | | | | Cum. Dist | | | | Po/Pn | Ni in |
| Products | Wt % | Ni | Cu | S | Pn | Cp | Po | Ni | Pn | Cp | Po | Ratio | NiBS |
| Feed | 100 | 1.31 | 0.30 | 28.0 | 2.43 | 0.86 | 67.6 | 100 | 100 | 100 | 100 | 27.8 | 1.88 |
| Conc 1: 0–3 min | 14.0 | 2.96 | 0.74 | 34.3 | 6.78 | 2.15 | 78.7 | 31.5 | 38.9 | 34.9 | 16.3 | 11.6 | 3.46 |
| 1 & 2: 7 min | 25.2 | 2.37 | 0.77 | 33.9 | 5.15 | 2.22 | 78.8 | 45.5 | 53.4 | 65.2 | 29.4 | 15.3 | 2.82 |
| 1 to 3: 13 min | 35.0 | 2.08 | 0.69 | 34.0 | 4.32 | 1.99 | 80.0 | 55.3 | 62.2 | 81.0 | 41.4 | 18.5 | 2.47 |
| 1 to 4: 20 min | 42.2 | 1.93 | 0.62 | 33.9 | 3.92 | 1.80 | 80.4 | 62.1 | 68.0 | 88.3 | 50.2 | 20.5 | 2.30 |
| Tails | 57.8 | 0.86 | 0.06 | 23.7 | 1.34 | 0.17 | 58.3 | 37.9 | 32.0 | 11.7 | 49.8 | 43.4 | 1.44 |

TABLE 2

| | | 0.30 Kg/ton DETA | | | | | | | | | | | |
|---|---|---|---|---|---|---|---|---|---|---|---|---|---|
| Flotation | Cum. | Cumulative Assays | | | | | | Cum. Dist | | | | Po/Pn | Ni in |
| Products | Wt % | Ni | Cu | S | Pn | Cp | Po | Ni | Pn | Cp | Po | Ratio | NiBS |
| Feed | 100 | 1.30 | 0.31 | 28.2 | 2.37 | 0.91 | 68.2 | 100 | 100 | 100 | 100 | 28.8 | 1.84 |
| Conc 1: 0–3 min | 16.3 | 2.59 | 1.07 | 33.6 | 5.79 | 3.10 | 76.9 | 32.5 | 39.7 | 55.3 | 18.4 | 13.3 | 3.13 |
| 1 & 2: 7 min | 26.8 | 2.23 | 0.89 | 33.0 | 4.80 | 2.58 | 76.8 | 46.2 | 54.3 | 75.8 | 30.2 | 16.0 | 2.74 |
| 1 to 3: 13 min | 33.8 | 2.07 | 0.78 | 32.4 | 4.38 | 2.27 | 75.8 | 54.0 | 62.3 | 84.0 | 37.6 | 17.3 | 2.58 |
| 1 to 4: 20 min | 36.2 | 2.04 | 0.76 | 31.7 | 4.33 | 2.21 | 74.0 | 57.2 | 66.2 | 87.8 | 39.3 | 17.1 | 2.61 |
| Tails | 63.8 | 0.87 | 0.06 | 26.3 | 1.26 | 0.17 | 64.9 | 42.8 | 33.8 | 12.2 | 60.7 | 51.7 | 1.32 |

As may be seen from these two tables, the flotation selectivity achieved using DETA is comparable to that of the blank test. The Po/Pn ratio of the concentrates (17 to 20) and the tailing grades (1.3 to 1.4% Ni/NBS) are high, indicating that the efficiency of pentlandite-pyrrhotite separation is poor regardless of the DETA usage.

The data in Table 1 and Table 2 demonstrate that the use of DETA does not produce a desirable selectivity in the flotation of the process middlings tested.

EXAMPLE 2

In this example, the influence of the reagent structure on pyrrhotite depression is examined so that a performance comparison can be made between the configuration NCCNCCN (e.g., diethylenetriamine) and OCNCCCNCNC (e.g., histidine). A different batch of samples was taken from the same process stream and prepared and tested in the laboratory using the same procedure as described in Example 1. The data obtained with 0.30 Kg/ton of DETA and L-Histidine additions are given in Tables 3, 4 and 5.

TABLE 3

| Flotation Products | Cum. Wt % | Cumulative Assays Ni | Cu | S | Pn | Cp | Po | Cum. Dist Ni | Pn | Cp | Po | Po/Pn Ratio | Ni in NiBS |
|---|---|---|---|---|---|---|---|---|---|---|---|---|---|
| 0.30 Kg/ton DETA | | | | | | | | | | | | | |
| Feed | 100 | 1.10 | 0.18 | 28.7 | 1.81 | 0.52 | 70.1 | 100 | 100 | 100 | 100 | 38.8 | 1.54 |
| Conc 1: 0–7 min | 23.9 | 2.02 | 0.47 | 33.4 | 4.18 | 1.37 | 79.3 | 43.7 | 55.2 | 62.7 | 27.0 | 19.0 | 2.42 |
| 1 to 2: 12 min | 36.7 | 1.73 | 0.37 | 32.4 | 3.41 | 1.08 | 77.5 | 57.5 | 69.2 | 76.2 | 40.5 | 22.7 | 2.14 |
| 1 to 3: 20 min | 41.5 | 1.67 | 0.36 | 31.7 | 3.26 | 1.03 | 75.9 | 62.7 | 74.8 | 82.1 | 44.9 | 23.3 | 2.11 |
| Tails | 58.5 | 0.70 | 0.05 | 26.6 | 0.78 | 0.16 | 66.1 | 37.3 | 25.2 | 17.9 | 55.1 | 84.8 | 1.05 |

TABLE 4

| Flotation Products | Cum. Wt % | Cumulative Assays Ni | Cu | S | Pn | Cp | Po | Cum. Dist Ni | Pn | Cp | Po | Po/Pn Ratio | Ni in NiBS |
|---|---|---|---|---|---|---|---|---|---|---|---|---|---|
| 0.30 Kg/t L-HISTIDINE | | | | | | | | | | | | | |
| Feed | 100 | 1.12 | 0.18 | 28.8 | 1.85 | 0.54 | 70.5 | 100 | 100 | 100 | 100 | 38.1 | 1.55 |
| Conc 1: 0–7 min | 23.1 | 2.05 | 0.51 | 34.1 | 4.23 | 1.48 | 80.9 | 42.2 | 52.8 | 63.7 | 26.5 | 19.1 | 2.41 |
| 1 to 2: 12 min | 34.5 | 1.78 | 0.41 | 32.6 | 3.52 | 1.19 | 77.9 | 54.7 | 65.8 | 76.4 | 38.1 | 22.1 | 2.18 |
| 1 to 3: 20 min | 39.3 | 1.70 | 0.39 | 31.7 | 3.35 | 1.12 | 75.8 | 59.6 | 71.3 | 82.0 | 42.3 | 22.6 | 2.15 |
| Tails | 60.7 | 0.75 | 0.06 | 27.0 | 0.87 | 0.16 | 67.0 | 40.4 | 28.7 | 18.0 | 57.7 | 76.7 | 1.10 |

TABLE 5

| Flotation Products | Cum. Wt % | Cumulative Assays Ni | Cu | S | Pn | Cp | Po | Cum. Dist Ni | Pn | Cp | Po | Po/Pn Ratio | Ni in NiBS |
|---|---|---|---|---|---|---|---|---|---|---|---|---|---|
| 100 ml K, 1.25 Kg/t SMBS, 0.30 Kg/t L-HISTIDINE | | | | | | | | | | | | | |
| Feed | 100 | 1.09 | 0.19 | 29.4 | 1.72 | 0.54 | 72.0 | 100 | 100 | 100 | 100 | 41.8 | 1.47 |
| Conc 1: 0–7 min | 18.0 | 2.31 | 0.67 | 32.4 | 5.06 | 1.95 | 75.4 | 38.5 | 52.9 | 65.2 | 18.9 | 14.9 | 2.88 |
| 1 to 2: 12 min | 21.5 | 2.19 | 0.64 | 31.2 | 4.77 | 1.84 | 72.8 | 43.5 | 59.5 | 73.4 | 21.7 | 15.3 | 2.83 |
| 1 to 3: 20 min | 23.3 | 2.14 | 0.62 | 30.4 | 4.64 | 1.79 | 70.9 | 46.0 | 62.9 | 77.4 | 23.0 | 15.3 | 2.83 |
| Tails | 76.7 | 0.77 | 0.06 | 29.1 | 0.83 | 0.16 | 72.3 | 54.0 | 37.1 | 22.6 | 77.0 | 86.6 | 1.05 |

By a comparison of the cumulative grade and recoveries, it may be noted that overall impact of these two reagents are essentially similar on the depression of pyrrhotite. Note, however, that the level of pyrrhotite depression is quite poor in both cases. Table 5 shows the results obtained using 100 ml of reagent K and 1.25 Kg/ton sodium metabisulphite (SMBS) in addition to 0.30 Kg/ton L-Histidine. A comparison of this data with those of the previous two tables indicates that the recovery of pyrrhotite is lower at any given recovery of pentlandite.

EXAMPLE 3

In this example, the function of triethylenetetramine (TETA) is examined. The first test, representing the standard experiment was carried out using 0.20 Kg/ton TETA in addition to 0.01 Kg/ton isobutyl xanthate and 0.007 Kg/ton DOWFROTH TM 250. The results shown in Table 6 indicate an overall pentlandite recovery of about 76% with a corresponding pyrrhotite recovery of 65%.

TABLE 6

| Flotation Products | Cum. Wt % | Cumulative Assays Ni | Cu | S | Pn | Cp | Po | Cum. Dist Ni | Pn | Cp | Po | Po/Pn Ratio | Ni in NiBS |
|---|---|---|---|---|---|---|---|---|---|---|---|---|---|
| 0.20 Kg/ton TETA | | | | | | | | | | | | | |
| Feed | 100 | 1.08 | 0.17 | 26.5 | 1.83 | 0.48 | 64.7 | 100 | 100 | 100 | 100 | 35.3 | 1.62 |
| Conc 1: 0–3 min | 27.2 | 1.74 | 0.43 | 31.8 | 3.46 | 1.25 | 75.9 | 44.0 | 51.4 | 70.2 | 32.0 | 21.9 | 2.19 |
| 1 & 2: 7 min | 38.9 | 1.55 | 0.35 | 32.1 | 2.92 | 1.01 | 77.3 | 56.1 | 62.1 | 81.4 | 46.4 | 26.4 | 1.94 |
| 1 to 3: 3 min | 49.5 | 1.44 | 0.29 | 32.1 | 2.60 | 0.85 | 77.7 | 68.1 | 70.2 | 87.1 | 59.4 | 29.9 | 1.79 |
| 1 to 4: 21 min | 53.9 | 1.41 | 0.28 | 31.7 | 2.52 | 0.81 | 76.8 | 70.2 | 74.1 | 90.3 | 63.9 | 30.5 | 1.77 |
| 1 to 5: 30 min | 55.7 | 1.40 | 0.28 | 31.3 | 2.51 | 0.80 | 75.8 | 72.1 | 76.4 | 92.0 | 65.2 | 30.2 | 1.78 |
| Tails | 44.3 | 0.68 | 0.03 | 20.6 | 0.98 | 0.09 | 50.9 | 27.9 | 23.6 | 8.0 | 34.8 | 52.0 | 1.31 |

The combined concentrate has a pyrrhotite/pentlandite ratio of about 30. Another test was carried out using a feed similar and a procedure identical to that in the previous test, in which about 0.50 Kg/ton $SO_2$ was employed in addition to reagents and dosages used in the standard case, The results obtained in this test are illustrated in Table 7 and can be compared to the data of Table 6. When one of the options disclosed in the current invention is used, the recovery of pyrrhotite is lower at any given pentlandite recovery, Although part of pentlandite is rendered non-floatable the overall concentrate grade is unequivocally better with a pyrrhotite/pentlandite ratio of almost half of that obtained in standard test.

The data given in Tables 6 and 7 demonstrate the effectiveness of the current invention when the number of ethyleneamine units in diethylenetriamine is changed.

TABLE 7

| Flotation Products | Cum. Wt % | 0.50 Kg/ton $SO_2$, 0.20 Kg/ton TETA Cumulative Assays Ni | Cu | S | Pn | Cp | Po | Cum. Dist Ni | Pn | Cp | Po | Po/Pn Ratio | Ni in NiBS |
|---|---|---|---|---|---|---|---|---|---|---|---|---|---|
| Feed | 100 | 1.08 | 0.18 | 26.5 | 1.83 | 0.51 | 64.7 | 100 | 100 | 100 | 100 | 35.3 | 1.62 |
| Conc 1: 0–3 min | 10.5 | 2.94 | 1.09 | 29.5 | 6.95 | 3.16 | 65.6 | 28.5 | 39.7 | 64.7 | 10.6 | 9.4 | 4.05 |
| 1 & 2: 7 min | 15.5 | 2.51 | 0.89 | 29.5 | 5.74 | 2.58 | 67.1 | 36.1 | 48.5 | 78.1 | 16.1 | 11.7 | 3.45 |
| 1 to 3: 13 min | 20.0 | 2.24 | 0.75 | 29.2 | 4.99 | 2.17 | 67.4 | 41.5 | 54.3 | 84.7 | 20.8 | 13.5 | 3.09 |
| 1 to 4: 21 min | 23.0 | 2.11 | 0.68 | 28.6 | 4.65 | 1,98 | 66.2 | 44.9 | 58.2 | 88.9 | 23.5 | 14.2 | 2.98 |
| 1 to 5: 30 min | 25.1 | 2.03 | 0.64 | 27.8 | 4.46 | 1.86 | 64.6 | 47.2 | 61.0 | 91.5 | 25.1 | 14.5 | 2.94 |
| Tails | 74.9 | 0.76 | 0.02 | 26.1 | 0.95 | 0.06 | 64.7 | 52.8 | 39.0 | 8.5 | 74.9 | 67.8 | 1.16 |

EXAMPLE 4

In this example, results of three additional tests are examined. These tests were conducted on Po-Pn middlings containing higher nickel and copper grades (i.e., 1.41% nickel and 0.30% copper in the head sample) after grinding in the laboratory to about 83% finer than 44 micrometers. In each case, two concentrates were collected after a flotation period of 7 and 30 minutes, respectively. Metallurgical performances are given in Table 8. In the first test, flotation feed received only 0.30 Kg/ton DETA. In the second test, 0.50 Kg/ton $SO_2$ was employed in addition to 0.30 Kg/ton DETA used in the first test. The third test involved the use of 70 ml reagent K and 1.30 Kg/ton SMBS in addition to 0.40 Kg/ton DETA. The nickel and copper grades of the concentrates obtained in test 2 and test 3 are substantially higher than those obtained in the first test where only DETA was used. The procedure applied in the third test produced a tailing which has a Po/Pn ratio of about 157 compared to 110 and 127 in the second and first test.

The data in Table 8 generally demonstrates the effectiveness of the current invention in pyrrhotite rejection as it is applied to the process middlings having a feed grade of 1.42 % Ni and a Po/Pn ratio of about 28.

TABLE 8

| TEST No | Flotation Products | Cum. Wt % | Cumulative Assays Ni | Cu | S | Po | Cumulative Distribution Ni | Pn | Cp | Po | Po:Pn Ratio | Ni in NiBS |
|---|---|---|---|---|---|---|---|---|---|---|---|---|
| 1 | Feed | 100 | 1.41 | 0.29 | 30.4 | 73.8 | 100 | 100 | 100 | 100 | 28.3 | 1.86 |
| 0.30 Kg/t | Conc. 1: 7 min | 18.0 | 4.08 | 1.21 | 32.2 | 69.5 | 51.8 | 69.3 | 76.0 | 17.0 | 6.9 | 5.13 |
| DETA | 1 & 2: 30 min | 35.2 | 2.73 | 0.72 | 30.5 | 69.6 | 67.9 | 85.2 | 88.7 | 33.3 | 11.1 | 3.59 |
| | Tails | 46.8 | 0.70 | 0.05 | 30.4 | 75.8 | 32.1 | 14.8 | 11.3 | 66.7 | 127 | 0.92 |
| 2 | Feed | 100 | 1.42 | 0.30 | 30.3 | 73.0 | 100 | 100 | 100 | 100 | 27.7 | 1.88 |
| 0.50 Kg/t | Conc. 1: 7 min | 8.7 | 7.20 | 2.56 | 31.0 | 55.7 | 44.0 | 62.3 | 73.6 | 6.6 | 2.9 | 9.66 |
| $SO_2$ & | 1 & 2 : 30 min | 17.1 | 4.69 | 1.53 | 26.1 | 51.8 | 56.3 | 77.9 | 86.3 | 12.1 | 4.3 | 7.34 |
| 0.30 Kg/t DETA | Tails | 82.9 | 0.75 | 0.05 | 31.1 | 77.4 | 43.7 | 22.1 | 13.7 | 87.9 | 110 | 0.96 |
| 3 | Feed | 100 | 1.41 | 0.30 | 29.9 | 72.3 | 100 | 100 | 100 | 100 | 27.5 | 1.89 |
| 70 ml K & | Conc. 1: 7 min | 19.7 | 4.11 | 1.22 | 32.2 | 69.4 | 57.4 | 76.1 | 80.4 | 19.0 | 6.9 | 5.18 |
| 1.30 Kg/t | 1 & 2 : 30 min | 22.1 | 3.25 | 0.90 | 28.8 | 63.6 | 66.9 | 87.0 | 88.1 | 25.6 | 8.1 | 4.55 |
| SMBS & 0.40 Kg/t DETA | Tails | 70.9 | 0.66 | 0.05 | 30.4 | 75.9 | 33.1 | 13.0 | 11.9 | 74.4 | 157 | 0.86 |

EXAMPLE 5

Tests were carried out with samples similar in composition to that of the preceding example. Contrary to the previous case, however, the samples involved are the product of a pilot plant. The nominal particle size is 80% finer than 44 micrometers. Bench scale tests with these samples were conducted at an initial pH of 9.5 to 9.8 and an average pulp density of 28% with no collector or frother addition into the 4-litre flotation cell. The results presented in Table 9 were obtained using 0.25 Kg/ton DETA alone which produced 45% pyrrhotite recovery at about 84% pentlandite recovery. As indicated by the data given in Table 10 and Table 11, the pentlandite-pyrrhotite separation is greatly aided by incorporating the two procedures of the current invention, namely, conditioning with 0.21 Kg/ton sodium sulphide and 0.29 Kg/ton barium sulphide, respectively, in combination with 1.05 Kg/ton sodium metabisulphite in addition to DETA used in each case.

TABLE 9

| Flotation Products | Cum. Wt % | 0.25 Kg/ton DETA Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| Feed | 100 | 1.40 | 0.24 | 29.3 | 2.62 | 0.70 | 70.9 | 100 | 100 | 100 | 100 | 27.0 | 1.91 |
| Conc 1: 0–3 min | 11.7 | 4.16 | 0.97 | 36.1 | 10.1 | 2.81 | 79.9 | 34.8 | 45.1 | 47.2 | 13.2 | 7.9 | 4.63 |
| 1 & 2: 7 min | 24.0 | 3.18 | 0.66 | 34.4 | 7.37 | 1.93 | 78.7 | 54.2 | 67.4 | 65.9 | 26.6 | 10.7 | 3.69 |
| 1 to 3: 13 min | 36.4 | 2.57 | 0.51 | 33.4 | 5.70 | 1.48 | 77.9 | 66.5 | 79.2 | 76.7 | 40.0 | 13.7 | 3.07 |
| 1 to 4: 20 min | 41.9 | 2.38 | 0.48 | 32.7 | 5.25 | 1.39 | 76.6 | 71.4 | 83.9 | 83.2 | 45.3 | 14.6 | 2.92 |
| Tails | 58.1 | 0.69 | 0.07 | 26.9 | 0.72 | 0.20 | 66.8 | 28.6 | 16.1 | 16.8 | 54.7 | 92.2 | 1.02 |

TABLE 10

| Flotation Products | Cum. Wt % | 0.21 Kg/ton $Na_2S$, 1.0 Kg/ton SMBS, 0.24 Kg/ton DETA Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| Feed | 100 | 1.40 | 0.23 | 28.8 | 2.62 | 0.66 | 69.6 | 100 | 100 | 100 | 100 | 26.5 | 1.93 |
| Conc 1: 0–3 min | 13.9 | 3.88 | 0.92 | 34.9 | 9.33 | 2.67 | 77.6 | 38.7 | 49.6 | 56.5 | 15.5 | 8.3 | 4.46 |
| 1 & 2: 7 min | 18.2 | 3.99 | 0.94 | 33.2 | 9.73 | 2.73 | 73.0 | 52.0 | 67.4 | 75.4 | 19.1 | 7.5 | 4.83 |
| 1 to 3: 13 min | 21.9 | 3.75 | 0.89 | 31.0 | 9.16 | 2.58 | 68.0 | 58.9 | 78.4 | 85.8 | 21.4 | 7.4 | 4.86 |
| 1 to 4: 20 min | 24.9 | 3.48 | 0.82 | 29.3 | 8.45 | 2.37 | 64.6 | 62.1 | 80.4 | 90.1 | 23.2 | 7.6 | 4.76 |
| Tails | 75.1 | 0.70 | 0.03 | 28.6 | 0.69 | 0.09 | 71.2 | 37.9 | 19.6 | 9.9 | 76.8 | 103.9 | 0.98 |

TABLE 11

| Flotation Products | Cum. Wt % | 0.29 Kg/ton BaS, 1.05 Kg/ton SMBS, 0.25 Kg/ton DETA Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| Feed | 100 | 1.42 | 0.25 | 28.5 | 2.71 | 0.73 | 68.8 | 100 | 100 | 100 | 100 | 25.4 | 1.99 |
| Conc 1: 0–3 min | 14.0 | 3.70 | 0.92 | 34.3 | 8.86 | 2.67 | 76.5 | 36.4 | 45.7 | 50.9 | 15.6 | 8.6 | 4.34 |
| 1 & 2: 7 min | 20.3 | 3.75 | 0.90 | 32.3 | 9.09 | 2.61 | 71.3 | 53.5 | 68.0 | 72.2 | 21.0 | 7.8 | 4.67 |
| 1 to 3: 13 min | 24.5 | 3.50 | 0.84 | 30.1 | 8.48 | 2.44 | 66.4 | 60.3 | 76.6 | 81.6 | 23.7 | 7.8 | 4.67 |
| 1 to 4: 20 min | 28.4 | 3.19 | 0.77 | 28.1 | 7.72 | 2.22 | 62.3 | 63.8 | 80.8 | 85.9 | 25.7 | 8.1 | 4.57 |
| Tails | 71.6 | 0.72 | 0.05 | 28.7 | 0.73 | 0.15 | 71.4 | 36.2 | 19.2 | 14.1 | 74.3 | 98.2 | 1.00 |

The particular options of the current invention for the pentlandite-pyrrhotite separation are further illustrated by the following additional examples.

EXAMPLE 6

The samples used in this series of tests originated from the same source as in the preceding example. Table 12 show the results of a standard test in which only 0.37 Kg/ton DETA was employed. The test was carried out at an initial pH of 10.3 at about 29% solids. As may be noted from Table 12, 53.5% of pyrrhotite reported to the concentrate along with 84% of pentlandite at the end of 20 minutes of flotation. A similar sample was floated in a test identical to the previous one. However, this test involved conditioning with 2.50 Kg/ton sodium sulphite ($Na_2SO_3$) in addition to 0.33 Kg/ton DETA. The results are given in Table 13.

TABLE 12

| Flotation Products | Cum. Wt % | 0.37 Kg/t DETA Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| Feed | 100 | 1.27 | 0.20 | 28.7 | 2.28 | 0.57 | 69.6 | 100 | 100 | 100 | 100 | 30.5 | 1.77 |
| Conc 1: 0—3 min | 13.9 | 3.34 | 0.77 | 35.6 | 7.78 | 2.23 | 81.0 | 36.5 | 47.5 | 54.3 | 16.2 | 10.4 | 3.76 |
| 1 & 2: 7 min | 27.5 | 2.55 | 0.53 | 34.9 | 5.61 | 1.53 | 81.6 | 55.2 | 67.6 | 73.6 | 32.2 | 14.5 | 2.93 |
| 1 to 3: 13 min | 41.0 | 2.12 | 0.41 | 34.2 | 4.43 | 1.18 | 81.2 | 68.5 | 79.6 | 84.6 | 47.8 | 18.4 | 2.48 |
| 1 to 4: 20 min | 46.3 | 2.02 | 0.38 | 33.9 | 4.14 | 1.10 | 80.7 | 73.4 | 84.0 | 89.1 | 53.6 | 19.5 | 2.38 |
| Tails | 53.7 | 0.63 | 0.04 | 24.2 | 0.68 | 0.12 | 60.1 | 26.6 | 16.0 | 10.9 | 46.4 | 88.9 | 1.04 |

TABLE 13

| Flotation Products | Cum. Wt % | 2.50 Kg/t Na2SO3, 0.33 Kg/t DETA Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| Feed | 100 | 1.19 | 0.20 | 27.1 | 2.13 | 0.59 | 65.8 | 100 | 100 | 100 | 100 | 31.0 | 1.75 |
| Conc 1: 0–3 min | 12.3 | 3.18 | 1.00 | 32.8 | 7.47 | 2.90 | 73.7 | 32.9 | 43.4 | 60.5 | 13.8 | 9.9 | 3.92 |
| 1 & 2: 7 min | 15.8 | 3.22 | 0.99 | 30.2 | 7.70 | 2.86 | 67.1 | 42.8 | 57.3 | 76.6 | 16.1 | 8.7 | 4.31 |
| 1 to 3: 13 min | 19.6 | 2.99 | 0.88 | 27.2 | 7.18 | 2.56 | 60.2 | 49.1 | 66.2 | 84.9 | 17.9 | 8.4 | 4.44 |
| 1 to 4: 20 min | 22.6 | 2.77 | 0.80 | 25.3 | 6.66 | 2.32 | 56.1 | 52.5 | 70.7 | 88.6 | 19.2 | 8.4 | 4.42 |
| Tails | 77.4 | 0.73 | 0.03 | 27.6 | 0.80 | 0.09 | 68.6 | 47.5 | 29.3 | 11.4 | 80.8 | 85.4 | 1.05 |

This procedure resulted in a substantial reduction in overall pyrrhotite recovery from 53.5% to 19.2% increasing the grade of overall concentrate from 2.4 to 4.4% Ni (as nickel bearing sulphides). Table 14 shows the results obtained using 2.50 Kg/ton sodium hydrosulphite ($Na_2S_2O_4$) in addition to 0.34 Kg/ton DETA at an initial pH of about 9.7. As may be noted from the metallurgical balance, this procedure also resulted in a significant increase in pyrrhotite depression and thus, a corresponding increase in the grade of the overall concentrate.

TABLE 14

| Flotation Products | Cum. Wt % | 2.50 Kg/t $Na_2S_2O_4$, 0.34 Kg/t DETA Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| Feed | 100 | 1.16 | 0.19 | 29.9 | 1.90 | 0.55 | 73.0 | 100 | 100 | 100 | 100 | 38.4 | 1.54 |
| Conc 1: 0–3 min | 1.2 | 3.17 | 0.09 | 34.7 | 7.36 | 2.61 | 78.8 | 30.7 | 43.4 | 53.2 | 12.1 | 10.7 | 3.68 |
| 1 & 2: 7 min | 14.4 | 3.18 | 0.92 | 32.9 | 7.45 | 2.67 | 74.1 | 39.5 | 56.4 | 69.8 | 14.6 | 9.9 | 3.89 |
| 1 to 3: 13 min | 16.4 | 3.10 | 0.90 | 31.3 | 7.31 | 2.62 | 70.4 | 44.1 | 63.3 | 78.5 | 15.8 | 9.6 | 3.99 |
| 1 to 4: 20 min | 17.9 | 3.00 | 0.87 | 30.3 | 7.09 | 2.53 | 67.9 | 46.6 | 66.9 | 82.7 | 16.7 | 9.6 | 4.00 |

TABLE 14-continued

| Flotation Products | Cum. Wt % | Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| 2.50 Kg/t $Na_2S_2O_4$, 0.34 Kg/t DETA | | | | | | | | | | | | | |
| Tails | 82.1 | 0.75 | 0.04 | 29.8 | 0.77 | 0.12 | 74.1 | 53.4 | 33.1 | 17.3 | 83.3 | 96.7 | 1.00 |

The process was also tested on samples produced on a commercial scale operation. Because of a preceding magnetic separation stage involved, the Po-Pn middlings are higher in pyrrhotite content, typically 75–85%. Re-grind cyclone overflow from the plant circuit produces a flotation feed at about 75% finer than 44 micrometers. At the time of sampling, the circuits were being operated at a density of about 40% solids in the pulp having a pH range 11.2 to 11.5 (adjusted by milk of lime). The flotation tests were carried out using 0.005 Kg/ton NalBX as collector with no frother addition and no adjustment of pulp density. Table 15 shows the test results obtained with 3.33 Kg/ton $SO_2$ and 0.37 Kg/ton DETA.

Initial flotation pH for this test was about pH 9, a readjusted value after conditioning with $SO_2$ As can be noted from data, about 75% pentlandite was recovered along with only 15% of pyrrhotite.

The data presented in the tables of this example demonstrate the effectiveness of the current invention in that the application of each option induced substantial selectivity in favour of pentlandite flotation.

TABLE 15

| Flotation Products | Cum. Wt % | Cumulative Assays Ni | Cu | S | Pn | Cp | Po | Cum.Dist Ni | Pn | Cp | Po | Po/Pn Ratio | Ni in NiBS |
|---|---|---|---|---|---|---|---|---|---|---|---|---|---|
| 3.33 Kg/t $SO_2$, 0.37 Kg/t DETA | | | | | | | | | | | | | |
| Feed | 100 | 1.19 | 0.15 | 32.7 | 1.88 | 0.45 | 80.2 | 100 | 100 | 100 | 100 | 42.6 | 1.46 |
| Conc 1: 0–3 min | 3.8 | 7.35 | 2.42 | 32.0 | 19.2 | 7.02 | 58.2 | 23.4 | 38.9 | 59.5 | 2.8 | 3.0 | 9.49 |
| 1 & 2: 7 min | 6.5 | 6.30 | 1.88 | 30.7 | 16.4 | 5.46 | 58.8 | 34.2 | 56.3 | 78.9 | 4.7 | 3.6 | 8.39 |
| 1 to 3: 13 min | 9.3 | 5.19 | 1.48 | 30.0 | 13.3 | 4.28 | 60.6 | 40.2 | 65.3 | 88.4 | 7.0 | 4.6 | 7.03 |
| 1 to 4: 20 min | 13.7 | 3.95 | 1.04 | 30.1 | 9.75 | 3.03 | 64.8 | 45.4 | 71.2 | 92.8 | 11.1 | 6.6 | 5.30 |
| 1 to 5: 25 min | 17.9 | 3.27 | 0.82 | 30.4 | 7.84 | 2.38 | 67.8 | 49.2 | 74.8 | 95.2 | 15.2 | 8.7 | 4.33 |
| Tails | 82.1 | 0.74 | 0.01 | 33.2 | 0.58 | 0.03 | 82.9 | 50.8 | 25.2 | 4.8 | 84.8 | 143.3 | 0.89 |

EXAMPLE 7

In this example, the process behaviour of a different ore floated with various types of collector/promoter and frother is examined. A sample of zinc-copper ore from Timmins region containing about 45% pyrrhotite was subjected to flotation using the procedure given below. A 2-Kg sample was ground in a laboratory rod mill at 65% solids to 80% finer than 44 micrometers in the presence of 0.15 Kg/ton DETA. An additional 0.35 Kg/ton was introduced during flotation. In the first stage of flotation, the pulp was conditioned with 0.175 Kg/ton DETA, 0.025 Kg/ton of Cyanamid TM AEROPHINE 3418A (dibutyl diphosphinate), 0.010 Kg/ton of Cyanamid TM AEROFLOAT 208 (ethyl plus sec. butyl dithiophosphate) and 0.010 Kg/ton MIBC (methyl isobutyl carbinol) for a total period of about 5 minutes. Two concentrates were collected for the periods of 0–4 and 4–10 min. In the second stage, the pulp was further conditioned with 0.175 Kg/ton DETA, 0.0375 Kg/ton of Cyanamid TM AERO xanthate 317 (isobutyl xanthate) and 0.005 Kg/ton of DOWFROTH TM 250 to collect two additional concentrates for the periods of 10–14 and 14–20 min. The initial flotation pH for the first and second stages was about 10.8 and 10.5, respectively. Table 16 shows the metallurgical balance obtained according to this method.

Another test was carried out using a procedure identical to the previous one with the exception that 1.07 Kg/ton sulphur dioxide was introduced prior to first stage of flotation. The data from this test given in Table 17 may be compared to that in Table 16. The use of sulphur dioxide as one option of the current invention results in a lower recovery of iron and sulphur at any given recovery of zinc, copper and lead. Accordingly, the iron and sulphur contents of the final tailing increase from 22.5 and 7.7 to 30.3 and 14.4 respectively. The image analysis and microscopic point count indicated 42.2% pyrrhotite in the tails sample produced in the current invention compared to only about 18.2% pyrrhotite when DETA was used alone.

TABLE 16

| Flotation Products | Cum. Wt % | Cumulative Assays Cu | Zn | Fe | Pb | S | Cumulative Distribution Cu | Zn | Fe | Pb | S |
|---|---|---|---|---|---|---|---|---|---|---|---|
| 0.50 Kg/t DETA | | | | | | | | | | | |
| Feed | 100 | 1.07 | 5.89 | 39.8 | 0.04 | 30.1 | 100 | 100 | 100 | 100 | 100 |
| Conc 1: 0–4 min | 24.4 | 3.08 | 9.25 | 39.8 | 0.12 | 41.1 | 70.0 | 38.3 | 24.3 | 63.5 | 33.2 |
| 1 & 2: 10 min | 34.5 | 2.86 | 11.39 | 38.9 | 0.06 | 39.5 | 92.1 | 66.8 | 33.7 | 79.4 | 45.3 |
| 1 to 3: 14 min | 62.8 | 1.66 | 8.85 | 44.3 | 0.02 | 38.2 | 97.4 | 94.4 | 69.9 | 89.8 | 79.7 |
| 1 to 4: 20 min | 74.3 | 1.42 | 7.85 | 45.8 | 0.01 | 37.9 | 98.8 | 99.1 | 85.5 | 93.6 | 93.5 |
| Tails | 25.7 | 0.05 | 0.20 | 22.5 | 0.01 | 7.7 | 1.2 | 0.9 | 14.5 | 8.4 | 6.5 |

TABLE 17

| Flotation Products | Cum. Wt % | 1.07 Kg/t $SO_2$, 0.5 Kg/t DETA Cumulative Assays Cu | Zn | Fe | Pb | S | Cumulative Distribution Cu | Zn | Fe | Pb | S |
|---|---|---|---|---|---|---|---|---|---|---|---|
| Feed | 100 | 1.05 | 5.83 | 39.4 | 0.05 | 30.0 | 100 | 100 | 100 | 100 | 100 |
| Conc 1: 0–4 min | 15.5 | 4.00 | 8.30 | 39.0 | 0.16 | 40.8 | 58.7 | 22.0 | 15.3 | 50.7 | 21.1 |
| 1 & 2: 10 min | 22.3 | 4.09 | 11.29 | 36.7 | 0.08 | 38.9 | 86.7 | 43.3 | 20.8 | 62.3 | 29.0 |
| 1 to 3: 14 min | 51.3 | 1.97 | 9.43 | 42.4 | 0.03 | 38.5 | 95.8 | 83.1 | 55.3 | 82.5 | 66.0 |
| 1 to 4: 20 min | 66.6 | 1.56 | 8.60 | 43.9 | 0.02 | 37.8 | 98.4 | 98.3 | 74.3 | 90.0 | 83.9 |
| Tails | 33.4 | 0.05 | 0.30 | 30.3 | 0.02 | 14.4 | 1.6 | 1.7 | 25.7 | 10.0 | 16.1 |

The data set forth in Tables 16 and 17 demonstrate the effectiveness of the current invention for other type of sulphide minerals associated with iron sulphides, specifically pyrrhotite, which may require a different flotation practice using various types of collector and frother combinations.

EXAMPLE 8

One of the treatment options disclosed in the current invention has been tested using a 300 kg/h pilot plant. The pH value in these tests was 9.0–9.6. The grinding circuit product was 78–80% finer than 44 micrometers. Typical results obtained from six pilot runs are shown in Table 18. The first test was carried out with no reagent addition; pentlandite and pyrrhotite recoveries obtained in the presence of residual reagents alone were 70.7% and 46.9% respectively. In test 2, which featured the addition of 0.030 Kg/ton sodium isobutylxanthate and 0.50 Kg/ton DETA, the recoveries of all sulphides increased. As can be judged from the grade (2.37 and 2.34% Ni in NiBS), Po/Pn ratio (19– 20) of the concentrates obtained in these two cases, the impact of DETA as a pyrrhotite depressant is nil. Tests 3, 4, 5 and 6 were carried out under similar operating conditions using $SO_2$ (2.6–2.9 Kg/ton) in addition to NalBX (0.015–0.030 Kg/ton), DETA (0.25–0.50 Kg/ton). In each case, pyrrhotite recovery to the concentrate has been substantially reduced resulting in higher nickel grades.

TABLE 18

| PILOT PLANT TEST No | Flotation Products | Cum. Wt % | Assays Ni | Cu | S | Po | Distribution Ni | Pn | Cp | Po | Po:Pn Ratio | Ni in NiBS |
|---|---|---|---|---|---|---|---|---|---|---|---|---|
| 1 | Feed | 100 | 1.26 | 0.23 | 27.8 | 67.4 | 100 | 100 | 100 | 100 | 29.5 | 1.81 |
| No reagent | Conc. | 39.5 | 1.99 | 0.43 | 33.7 | 80.1 | 62.5 | 70.7 | 73.4 | 46.9 | 19.6 | 2.37 |
| Addition | Tails | 60.5 | 0.78 | 0.10 | 24.0 | 59.1 | 37.5 | 29.4 | 26.6 | 53.1 | 53.3 | 1.29 |
| 2 | Feed | 100 | 1.24 | 0.20 | 26.2 | 63.5 | 100 | 100 | 100 | 100 | 27.4 | 1.89 |
| 0.5 Kg/t DETA | Conc. | 52.6 | 1.72 | 0.31 | 29.3 | 69.9 | 72.5 | 79.6 | 83.2 | 57.9 | 20.0 | 2.34 |
| 0.03 Kg/t IBX | Tails | 47.4 | 0.72 | 0.07 | 22.8 | 56.3 | 27.5 | 20.4 | 16.8 | 42.1 | 56.6 | 1.26 |
| 3 | Feed | 100 | 1.21 | 0.19 | 29.5 | 72.3 | 100 | 100 | 100 | 100 | 35.4 | 1.62 |
| 2.9 Kg/t $SO_2$ | Conc. | 18.8 | 3.16 | 0.76 | 26.2 | 57.4 | 49.3 | 70.8 | 74.7 | 14.9 | 7.5 | 4.84 |
| 0.25 Kg/t DETA | Tails | 81.2 | 0.75 | 0.06 | 30.5 | 75.8 | 50.7 | 29.3 | 25.3 | 85.1 | 103 | 0.98 |
| 0.015 Kg/t IBX | | | | | | | | | | | | |
| 4 | Feed | 100 | 1.44 | 0.25 | 28.5 | 68.7 | 100 | 100 | 100 | 100 | 24.8 | 2.02 |
| 2.9 Kg/t $SO_2$ | Conc. | 14.5 | 5.35 | 1.24 | 24.9 | 47.8 | 53.8 | 72.9 | 72.5 | 10.1 | 3.4 | 8.65 |
| 0.5 Kg/t DETA | Tails | 85.5 | 0.78 | 0.08 | 29.1 | 72.2 | 46.2 | 27.1 | 27.5 | 89.9 | 82.4 | 1.07 |
| 0.03 Kg/t IBX | | | | | | | | | | | | |
| 5 | Feed | 100 | 1.10 | 0.24 | 28.8 | 70.2 | 100 | 100 | 100 | 100 | 38.9 | 1.53 |
| 2.6 Kg/t $SO_2$ | Conc. | 14.6 | 3.15 | 1.20 | 31.1 | 68.8 | 41.6 | 60.3 | 71.9 | 14.3 | 9.2 | 4.13 |
| 0.5 Kg/t DETA | Tails | 85.5 | 0.75 | 0.08 | 28.4 | 70.5 | 58.4 | 39.7 | 28.1 | 85.8 | 84.2 | 1.06 |
| 0.03 Kg/t IBX | | | | | | | | | | | | |
| 6 | Feed | 100 | 0.96 | 0.15 | 33.3 | 82.2 | 100 | 100 | 100 | 100 | 68.1 | 1.15 |
| 2.6 Kg/t $SO_2$ | Conc. | 4.8 | 5.78 | 2.15 | 30.9 | 59.8 | 28.5 | 58.6 | 68.0 | 3.5 | 4.0 | 7.73 |
| 0.5 Kg/t DETA | Tails | 95.3 | 0.72 | 0.05 | 33.4 | 83.3 | 71.5 | 41.4 | 31.9 | 96.51 | 159 | 0.86 |
| 0.03 Kg/t IBX | | | | | | | | | | | | |

In view of the 8 examples provided above, it will be recognized that the flotation feed used in the demonstration of the current invention represents a wide range of samples, whether they are unprocessed ore samples, or process middlings with their pyrrhotite content changing from about 60% to over 80% and pyrrhotite/-pentlandite ratios from 25 to about 68. The samples differ also by the mode of their production being represented by bench, pilot and plant scale operations and related process conditions to which they were subjected.

Inspection of the data presented in the tables of specific examples indicates that, in each case, depression selectivity for pyrrhotite is greatly increased by conditioning the pulp with sulphur-containing inorganic reagents and their suitable combinations used in conjunction with nitrogen-containing organic reagents, the preferred group being the polyethylenepolyamine family including diethylenetriamine and triethylenetetramine.

Therefore, the use, according to the current invention, of the specific conditioning stage accomplishing the overall objective of consistent pyrrhotite rejection constitutes a significant advance in the art of complex sulphide flotation and is highly effective in enhancing the separation efficiency between pyrrhotite and associated base metal sulphides containing non-ferrous metals, thus improving the grade of concentrates.

We claim:

1. A process for the concentration of at least one mono- or multi-metal sulphide mineral containing non-ferrous metal co-existing with pyrrhotite in a sulphide ore or its processed streams, the streams consisting essentially of middlings resulting from previous unit operations; the process comprising subjecting the ore or the streams to froth flotation employing at least one collector for said at least one mineral and frother for the production of bubbles from a gas phase introduced into said froth flotation, said process further comprising, prior to said froth flotation, conditioning the pulp containing a finely ground mixture of said mineral at an alkaline pH with at least one water soluble inorganic sulphur-containing compound selected from the group consisting of sulphides, sulphites dithionates, tetrathionates and sulphur dioxide, in an amount varying from 0.10 kg/ton to 3 kg/ton of dry solids processed, as an essential step for further conditioning with at least one nitrogen-containing organic compound having a configuration selected from the group consisting of OCNCCCNCNC and NCCN used at an adequate dosage for a particular flotation feed, wherein upon subjecting said further conditioned pulp to froth flotation, said pyrrhotite is depressed as a result of combined effects of said at least one sulphur-containing compound and said at least one nitrogen-containing organic compound, thereby allowing selective flotation and concentration of said mineral containing non ferrous metal.

2. A process according to claim 1 in which at least one metal value selected from the group consisting of nickel, copper, cobalt, platinum, palladium, gold, zinc and lead is part of said sulphide mineral.

3. A process according to claim 1 in which said at least one sulphide mineral is selected from the group consisting of pentlandite, chalcopyrite, sphalerite and galena and is part of said sulphide ore or its pre-treated process streams.

4. A process according to claim 1 in which said at least one mineral has undergone superficial oxidation prior to or during flotation.

5. A process according to claim 1 in which the nitrogen containing compounds are polyethylenepolyamines used in an amount varying from 0.05 to 0.6 kg/ton of dry solids processed.

6. A process according to claim 5 in which the number of ethyleneamine units in polyethylenepolyamine is equal to or greater than that in diethylenetriamine.

7. A process according to claim 1 in which the initial operating pH of the pulp is between about 6.5 and 12.

8. A process according to claim 1 in which the collector is xanthate, phosphine-based compounds or dithiophosphonates.

9. A process according to claim 1 in which said at least one water soluble inorganic sulphur-containing compound is selected from the group consisting of sulphides, hydrosulphides and polysulphides with a cationic part, wherein said cationic part is sodium, potassium, ammonium, calcium, barium or hydrogen.

10. A process according to claim 9 in which the sulphur-containing compound is calcium polysulphide.

11. A process according to claim 1 in which said at least one water soluble inorganic sulphur-containing compound is selected from the group consisting of sulphites, hydrosulphites, metabisulfites, dithionates, tetrathionate and sulphur dioxide with a cationic part, wherein said cationic part is sodium, potassium, ammonium, calcium, barium or hydrogen.

12. A process according to claim 11 in which the sulphur-containing compounds are tetrathionates which are prepared in situ by reacting a thiosulphate solution with sulphur dioxide or hydrogen peroxide.

13. A process according to claim 1 wherein the nitrogen-containing organic compound is a member selected from the group consisting of diethylenetriamine, triethylenetetramine and histidine.

14. A process according to claim 1 wherein the conditioning is carried out with at least one sulphur-containing compound selected from the group consisting of sulphides, hydrosulphides and polysulphides with a cationic part wherein said cationic part is sodium, potassium, ammonium, calcium, barium or hydrogen; and at least one sulphur-containing compound selected from the group consisting of sulphites, hydrosulphites, metabisulfites, dithionates, tetrathionate and sulphur dioxide with an associated cationic part, wherein said associated cationic part is sodium, potassium, ammonium, calcium, barium or hydrogen.

* * * * *